US006161825A

United States Patent [19]

Webster et al.

[11] Patent Number: 6,161,825

[45] **Date of Patent: *Dec. 19, 2000**

[54] CLAMPING DEVICE

[75] Inventors: Michael G. Webster; Jeff J. Adams, both of Boise, Id.

[73] Assignee: Micron Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 09/131,899

[22] Filed: Aug. 10, 1998

Related U.S. Application Data

[63] Continuation of application No. 08/653,624, May 24, 1996, Pat. No. 5,791,640.

[51] Int. Cl.[7] ..... B25B 1/10

[52] U.S. Cl. ..... 269/246; 269/287

[58] Field of Search ..... 269/139, 287, 269/111, 246, 247, 251, 285, 903, 279–284

[56] References Cited

U.S. PATENT DOCUMENTS

| | | | |
|---|---|---|---|
| 713,189 | 11/1902 | Yates | 269/283 |
| 1,278,419 | 9/1918 | Bader | 269/279 |
| 2,579,151 | 12/1951 | Lloyd | 269/282 |
| 2,724,201 | 11/1955 | Cavalero . | |
| 3,403,901 | 10/1968 | Servadio | 269/284 |
| 4,061,323 | 12/1977 | Beekenkamp . | |
| 4,824,085 | 4/1989 | Buchler . | |
| 5,419,540 | 5/1995 | Teafatiller | 269/283 |
| 5,595,378 | 1/1997 | Martinsson et al. . | |
| 5,791,640 | 8/1998 | Webster et al. | 269/246 |

*Primary Examiner*—Robert C. Watson

[57] ABSTRACT

A clamping device having a front member, a back member opposing the front member, a pair of opposing side members, a stop block and a clamping mechanism. The side members extend between and connect the front member and the back member. The work piece is supported by and between the side members. The stop block is interposed between the back member and the work piece. The clamping mechanism, which is operatively coupled between the front member and the work piece, exerts a clamping force against the work piece to press the work piece against the stop block. In this way, the work piece is clamped between the front member and the back member.

3 Claims, 7 Drawing Sheets

CLAMPING DEVICE

This application is a continuation of a pending application Ser. No. 08/653,624, filed on May 24, 1996 now U.S. Pat. No. 5,791,640.

FIELD OF THE INVENTION

The invention relates generally to a clamping device and, more particularly, to a clamping device that may be specially adapted for use in effecting a seal between components of mass flow controllers used in the manufacture of semiconductor devices.

BACKGROUND OF THE INVENTION

Semiconductor devices are mass produced by forming many identical circuit patterns on a single silicon wafer which is thereafter cut into many identical dies or "chips." Semiconductor devices, also commonly referred to as integrated circuits, are typically constructed by successively depositing or "stacking" layers of various materials on the wafer. Many of these layers are etched according to a predetermined pattern as part of the formation of the desired circuit components. Some of these materials are deposited, patterned and etched using processing techniques that require the introduction of gases into a reaction chamber or vessel. The gases react with one another and with the surface of the semiconductor wafers to deposit or remove the desired materials. For example, chemical vapor deposition ("CVD") and dry or "plasma" etching are two common semiconductor manufacturing processes that use reactant gases to deposit materials on and selectively remove materials from the surface of a semiconductor wafer.

Mass flow controllers are used to monitor and control the flow of the gases into the reaction chamber in CVD, plasma etching and other such semiconductor manufacturing processes. Mass flow controllers are used whenever accurate measurement and control of gas is required. A typical mass flow controller has two primary operational components—a mass flow meter and a proportioning controller. The flow meter measures the actual flow. The controller drives a variable displacement valve to the correct position to maintain the desired flow. The gas flows through three primary and discrete physical components in the mass flow controller—the inlet, the main body and the outlet. In one common configuration, the variable displacement valve is positioned in the inlet and the flow meter is positioned in the main body. Each of the above described components must be sealed one to the other to achieve effective operation of the mass flow controller. Mass flow controllers must be periodically disassembled for cleaning and repairing or replacing worn or malfunctioning parts. Upon re-assembly, care must be taken to ensure that the respective components are properly sealed. The latest generation of mass flow controllers, such as a Unit Instruments, Inc. Model UFC-1600 or Precision Flow Devices Model PFD 501M, utilize metal seals to effect a seal between the component surfaces. Metal seals require that the components be precisely aligned to effect the uniform distribution of tightening forces before the fasteners are tightened to secure and seal the components. In addition, metal seals require the application of much higher torque values to adequately tighten the fasteners.

Experience with the metal seals used in modern mass flow controllers has shown that it is difficult to obtain an effective seal unless the mass flow controller components are clamped together with evenly distributed pressure. The fasteners can then be uniformly tightened to meet the required torque specifications. In the past, the mass flow controller components were clamped together using an ordinary bench mounted vice. Obtaining a satisfactory seal using a vice is difficult and time consuming, particularly because the controller could not be readily and properly positioned for clamping. Unit Instruments, Inc. developed a prototype clamping device for use with its mass flow controllers. Like the bench vise, the Unit prototype did not afford the operator any way to support and accurately position the controller for clamping. The absence of a support/positioning mechanism and its substantial weight made the Unit prototype cumbersome to use and ineffective in consistently obtaining a reliable seal. The Unit prototype also was not adaptable for use with other brands of mass flow controllers.

SUMMARY OF THE INVENTION

Accordingly, the present invention is directed to a clamping device that may be specially adapted for use in sealing together the components of mass flow controllers such as those used in the manufacture of semiconductor devices. The invented clamping device is lightweight, easy to use and it is configurable to use with different brands and models of mass flow controllers. The invention may also be applied to work pieces other than a mass flow controller.

In one embodiment of the invention, the clamping device includes a front member, a back member opposing the front member, a pair of opposing side members, a stop block and a clamping mechanism. The side members extend between and connect the front member and the back member. The work piece is supported by and between the side members. The stop block is interposed between the back member and the work piece. The clamping mechanism, which is operatively coupled between the front member and the work piece, exerts a clamping force against the work piece to press the work piece against the stop block. In this way, the work piece is clamped between the front member and the back member.

In a second embodiment, the clamping device comprises an H shaped front end piece having a cross member extending between two upright members, a back end piece having two upright members, a pair of opposing side plates, a stop block and a clamping mechanism. Each of the side plates extends, respectively, between the upright members of the front end piece and the back end piece. The front end of the side plates is fastened to the upright members of the front end piece, The back end of the side plates is fastened to the upright members of the back end piece. Thus, the front end piece and the back end piece are connected through the side plates. A support rail is formed along the inner surface of each side plate. The support rail is sized and shaped to support the work piece. The stop block is removably interposed between the back end piece and the work piece. The clamping mechanism is operatively coupled between the front end piece and the work piece. The clamping mechanism exerts a clamping force against the work piece to press the work piece against the stop block.

In a third embodiment of the invention, the clamping device is specially adapted for use with a mass flow controller as the work piece. In this embodiment, the stop block consists of two or more interchangeable stop blocks. Each stop block is configured for use in sealing the various components of the controller based on the controller's orientation in the clamping device. That is, a first stop block is interposed between the back end piece and the controller when the controller is positioned in a first orientation to, for example, seal the inlet to the main body. A second stop block is substituted for the first stop block when the controller is re-oriented to a second orientation to, for example, seal the outlet to the main body.

BRIEF DESCRIPTION OF THE DRAWINGS

Like reference numerals designate like components on all Figures.

DETAILED DESCRIPTION OF THE INVENTION

Figure 1:
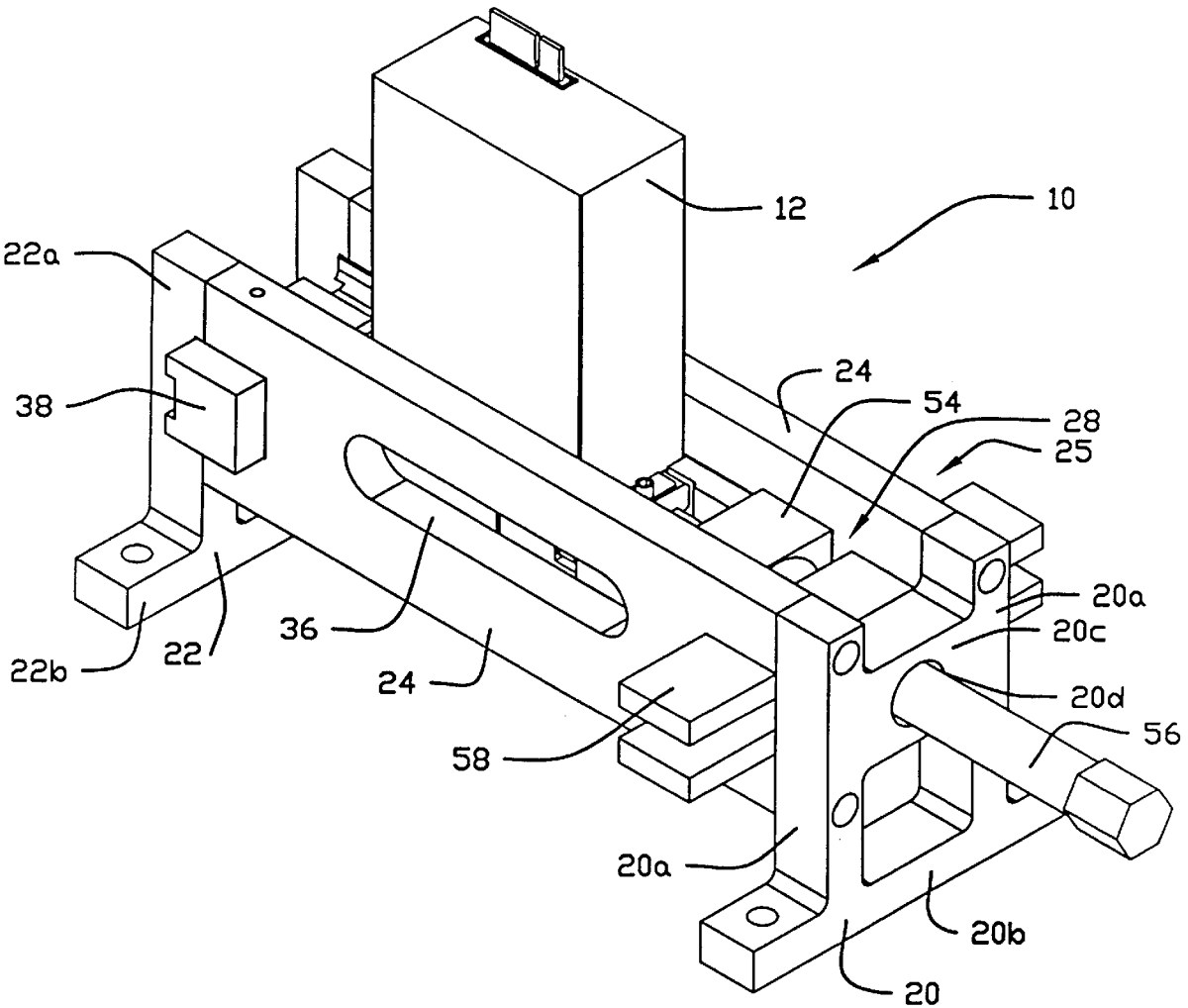
FIG. 1 is an isometric view of one embodiment of the clamping device showing the mass flow controller in a first orientation wherein the outlet of the controller is clamped against the main body of the controller to effect a seal therebetween.
Figure 2:
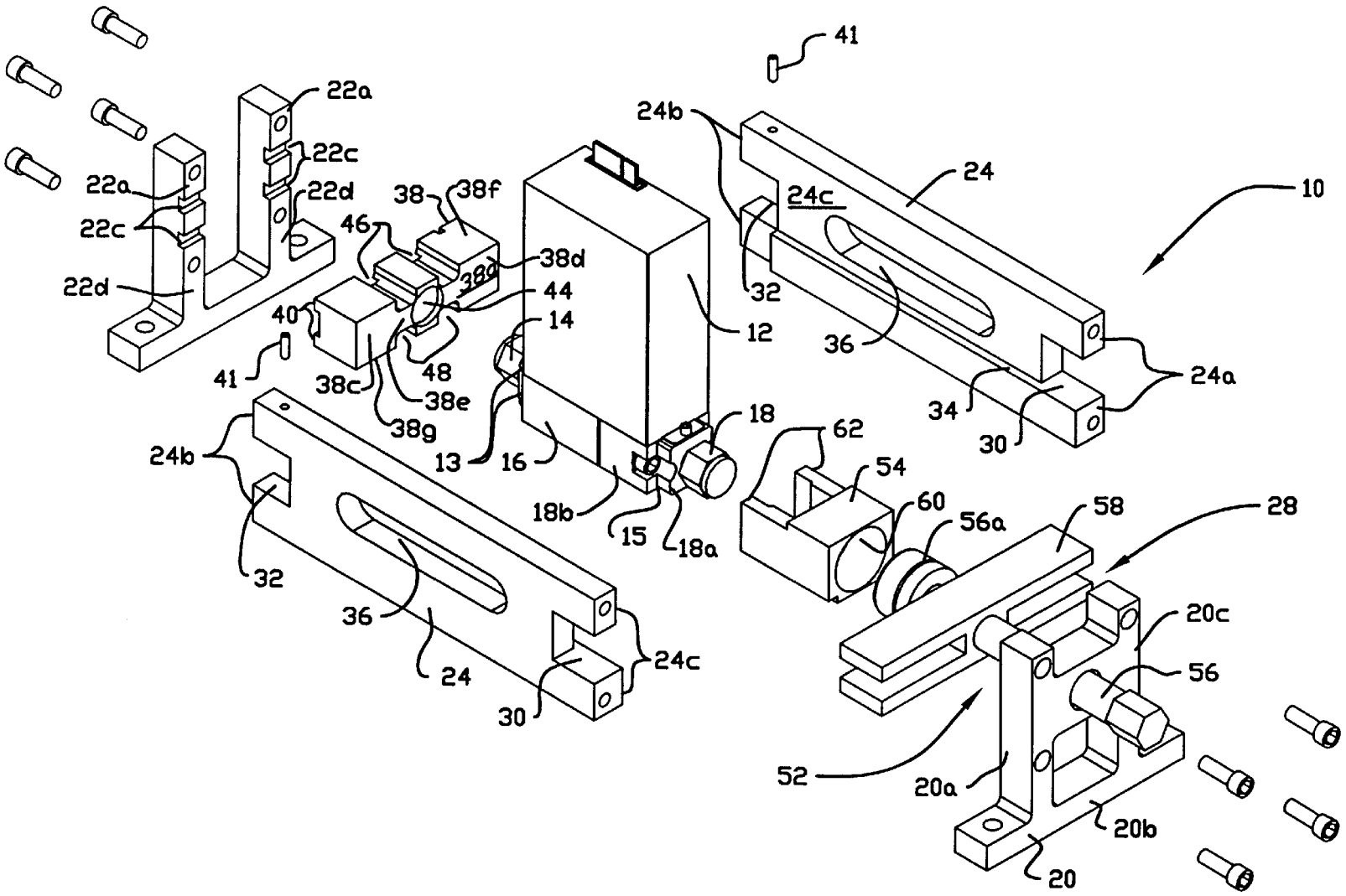
FIG. 2 is an exploded isometric view of the clamping device of FIG. 1.

FIGS. 1 and 2 illustrate one embodiment of the invented positioning fixture clamping device, which is indicated generally by reference numeral 10. Referring to FIGS. 1 and 2, clamp 10 clamps the outlet 14 and the main body 1 6 of mass flow controller 12 together to effect a seal therebetween. Clamp 10 includes a front end piece 20, a back end piece 22, a pair of side plates 24, a stop block 38 and a clamping mechanism 28. Front end piece 20 is constructed as an H shaped pedestal. Upright members 20*a* of front end piece 20 project up from a horizontal base 20*b*. A cross member 20*c* spans between upright members 20*a*. A hole 20*d* is made through cross member 20*b*. Back end piece 22 is constructed as a U shaped pedestal. Upright members 22*a* of back end piece 22 project up from a horizontal base 22*b*. A pair of horizontal grooves 22*c* are made in the inner face 22*d* of each of the upright members 22*a* of back end piece 22.

Figure 15:
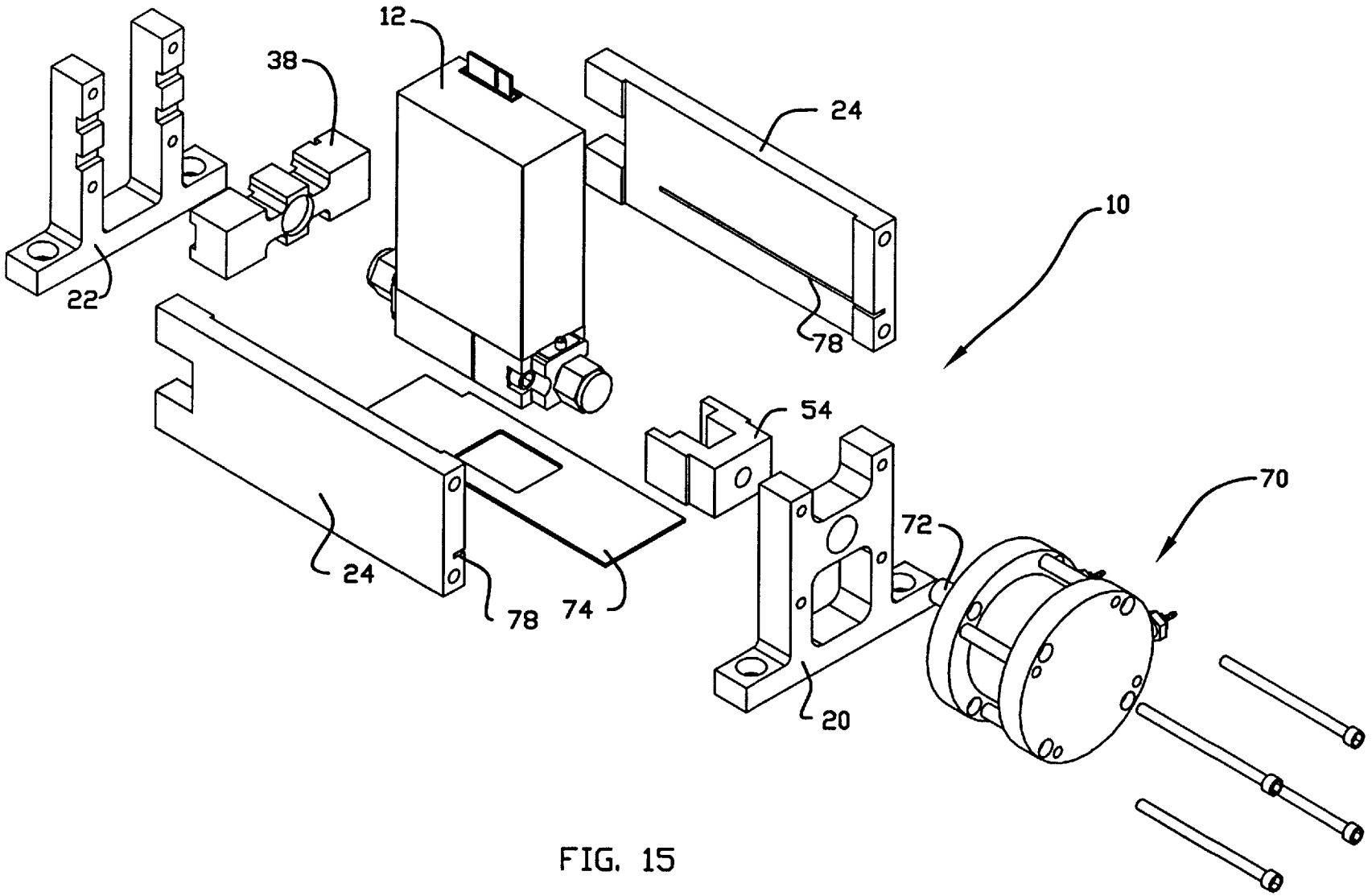
FIG. 15 is an exploded isometric view of a third embodiment of the clamping device wherein the clamping force is exerted by a pneumatic cylinder rather than a lead screw assembly as in the embodiments of FIGS. 1 and 6.

Side plates 24 are constructed as elongated generally rectangular plates that extend between and are fastened to uprights 20*a*, 22*a* of front and back plates 20, 22. The front ends 24*a* of side plates 24 are recessed to form lead screw channels 30. The back ends 24*b* of side plates 24 are recessed to form stop block channels 32. A support rail 34 extends along an inner surface 24*c* of each side plate 24 between lead screw channel 30 and stop block channel 32. Support rails 34 are preferably formed as an integral ledge machined into the inner surface 24*c* of side plates 24. Alternately, support rails 24 may be constructed as discrete plates fastened to the inner surfaces of each side plate or a support platform may be utilized (as shown in FIG. 15, reference numeral 74. Support rails 34 are sized and shaped as necessary to provide adequate support for controller 12. An optional elongated oval shaped opening 36 is made in side plates 24 to minimize the weight of the side plates and, correspondingly, of clamp 10. Front end piece 20, back end piece 22 and side plates 24 are referred to herein jointly as positioning fixture 25.

Figure 3:
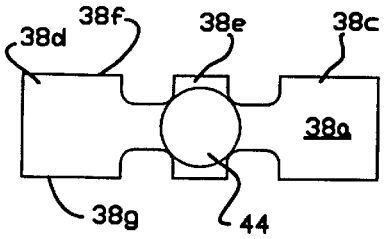
FIGS. 3, 4 and 5 are front, side and rear elevation views, respectively, of the stop block of the clamping device of FIG. 1.
Figure 4:
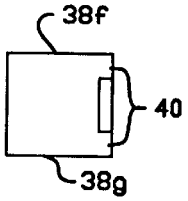
Figure 5:
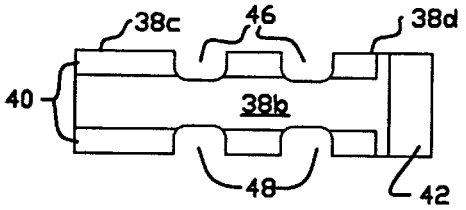

A removable first stop block 38 is interposed between back plate 22 and controller 12. First stop block 38, back end piece 22 and side plates 24 are configured to allow first stop block 38 to slide into and out of positioning fixture 25 properly aligned for clamping along the x, y and z axes. Set screws 41 in side plates 24 allow stop block 38 to be locked in place. First stop block 38 is aligned along the x and y axes according to stop block channels 32 in side plates 24 and grooves 22*c* in back end piece 22. Referring now also to FIGS. 3–5, first stop block 38 is constructed as a generally flat rectangular block that includes a front face 38*a*, a back face 38*b*, first side portion 38*c*, second side portion 38*d* and center portion 38*e* between the first and second side portions 38*c* and 38*d*. Side portions 38*c* and 38*d* are sized and shaped to fit into stop block channels 32. A pair of tongue members 40 project from back face 38*b*. Tongue members 40 are sized and shaped to fit into grooves 22*c* in back end piece 22. Tongue members 40 extend along first side portion 38*c*, across center portion 38*e* and into second side portion 38*d*. Tongue members 40 terminate at a z axis alignment stop 42 on second side portion 38*d*.

The center portion 38*e* of first stop block 38 is configured as necessary to properly engage controller 12 while simultaneously allowing access to the screws, bolts or other such fasteners used to secure and seal the controller inlet, outlet and main body components. A cylindrical opening 44 is formed in the center of front face 38*a*. Opening 44 is sized and shaped to engage end caps 19, which are placed on both inlet 18 and outlet 14 of controller 12 when the controller is not in use. One pair of U shaped channels 46 are formed in and fully across the upper surface 38*f* of first stop block 38 on either side of opening 44. Another pair of U shaped channels 48 are formed in and fully across the lower surface 38g of first stop block 38 on either side of opening 44. Channels 46 and 48 are positioned on first stop block 38 so that, upon insertion of stop block 38 into positioning fixture 25, channels 46 and 48 are aligned with the four fastening screws 13 used to secure outlet 14 to main body 16 of controller 12.

Figure 6:
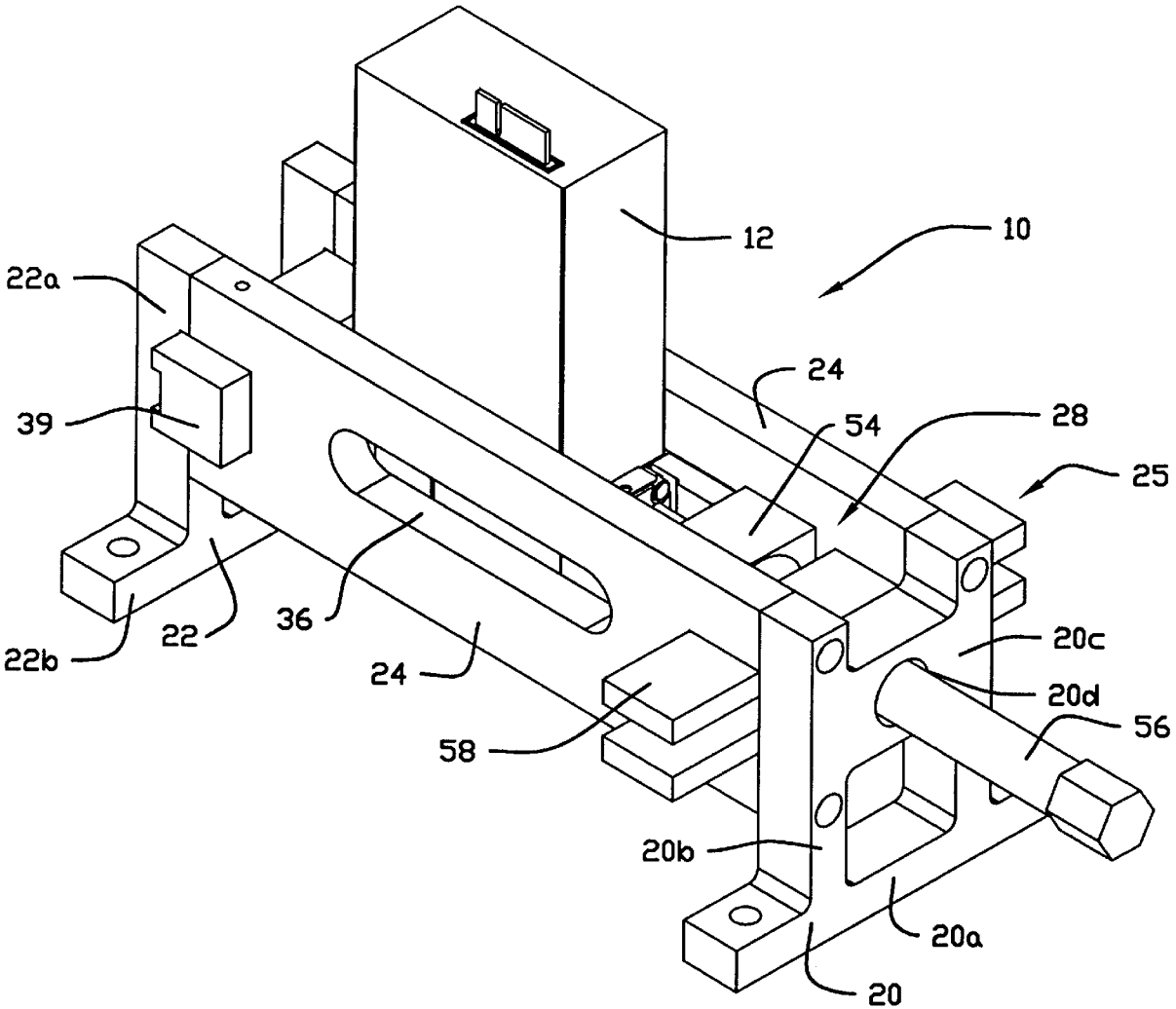
FIG. 6 is an isometric view of a second embodiment of the clamping device showing the mass flow controller in a second orientation wherein the inlet of the controller is clamped against the main body of the controller to effect a seal therebetween.
Figure 7:
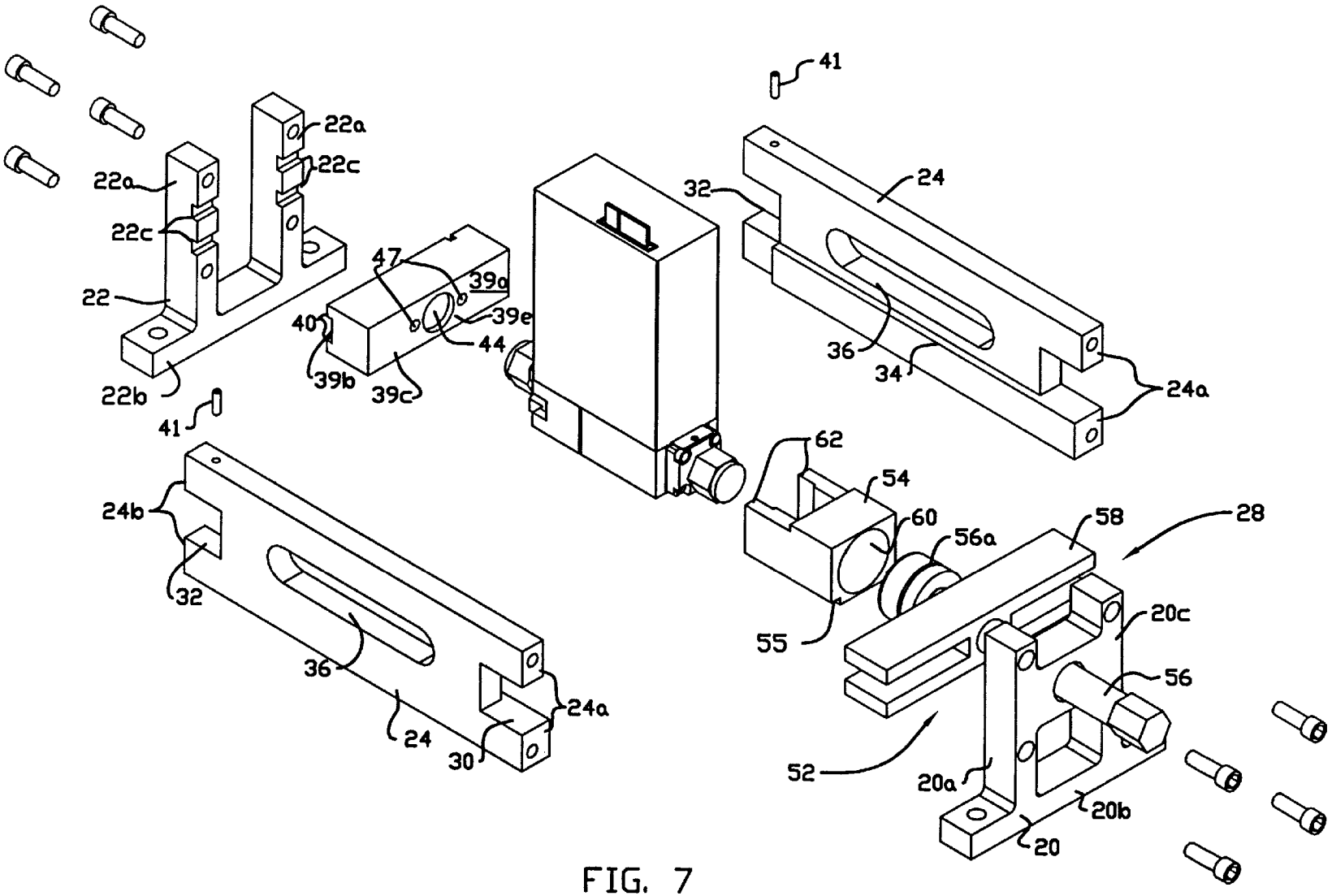
FIG. 7 is an exploded isometric view of the clamping device of FIG. 6.
Figure 11:
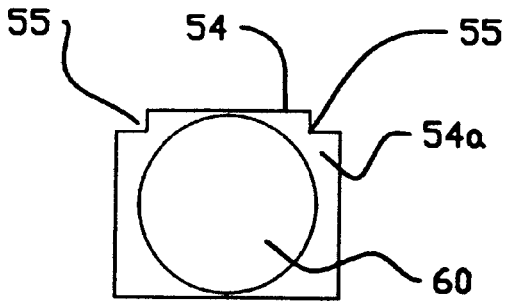
FIGS. 11, 12 and 13 are front, side and rear elevation views, respectively, of the clamping mechanism carriage of the clamping device of FIGS. 1 and 6.
Figure 14:
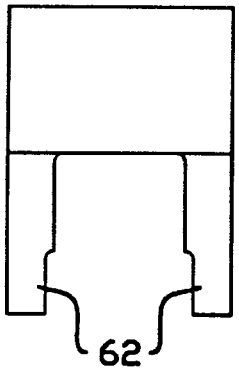
FIG. 14 is a plan view of the clamping mechanism carriage of the clamping device of FIGS. 1 and 6.
Figure 13:
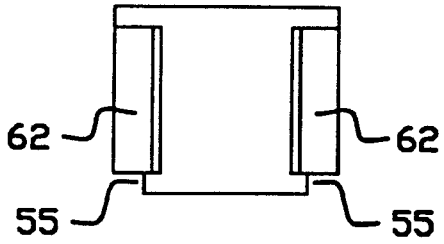
Figure 12:
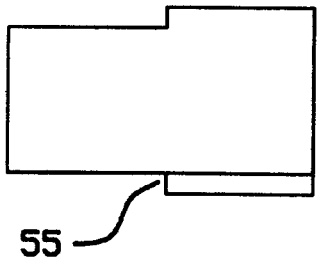

Referring again to FIGS. 1 and 2, a clamping mechanism 28 is operatively coupled between front end piece 20 and controller 12. Clamping mechanism 28 exerts a clamping force against controller 12 along the longitudinal z axis between front end piece 20 and back end piece 22 to press controller 12 against first stop block 38. Controller 12 is thereby clamped between front end piece 20 and back end piece 22. Preferably, clamping mechanism 28 consists of a lead screw 52 and a carriage 54. Lead screw 52 generates the clamping force and carriage 54 advances to transmit that force against controller 12. Lead screw 52 includes screw 56 and threaded mount block 58. Mount block 58 is constructed as a generally flat rectangular block sized and shaped to fit into lead screw channels 30 in front end 24*a* of side plates 24. Referring now also to FIGS. 11–14, carriage 54 is configured as necessary to properly engage controller 12. Carriage 54 is constructed as a generally U shaped block, as best seen in FIG. 14. A cylindrical opening 60 is formed in the front face 54*a* of carriage 54 for receiving end cap 56*a* of screw 56. Preferably, end cap 56*a* is fitted with a thrust bearing so that carriage 54 may remain rotationally stationary as screw 56 turns. Also preferably, end cap 56*a* of screw 56 is enlarged to better distribute the clamping force exerted against controller 12 and decrease the load on the thrust bearing located in end cap 56*a*. A pair of flange members 62 project horizontally along longitudinal axis z to engage controller 12. Flange members 62 are sized and shaped and spaced apart as necessary to engage body portion 18*a* of inlet 18 but clear (that is, not engage) the extremity portion 18*b* of inlet 18. Flange members 62 are also sized and shaped and spaced apart as necessary to engage main body 16 but clear (that is, not engage) inlet 14 when the controller is positioned as shown in FIGS. 6 and 7. Notches 55 along the bottom of carriage 54 engage with support rails 34 on side plates 24 so that carriage 54 is supported on rails 34.

The configuration of carriage 54 is simplified somewhat in comparison to the first stop block 38 because carriage 54 need not allow access to the screws, bolts or other such fasteners used to secure and seal the controller inlet, outlet and main body components. Thus, the same carriage can be used to engage both the outlet 14 and the main body 16 of controller 12, as best seen by comparing FIGS. 2 and 7. As will be apparent to those skilled in the art, the carriage illustrated herein may be re-configured as necessary to accommodate mass flow controllers different from those described.

Figure 8:
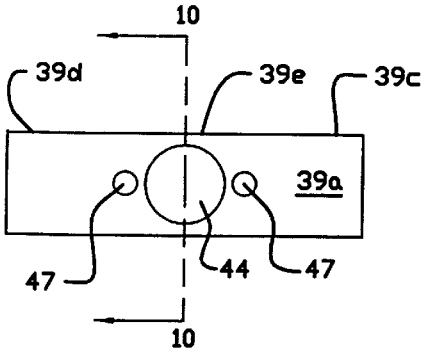
FIGS. 8 and 9 are front and rear elevation views, respectively, of the stop block of the clamping device of FIG. 6.
Figure 10:
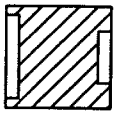
FIG. 10 is a cross section view of the stop block of the clamping device of FIG. 6 taken along the line 10—10 in FIG. 7.
Figure 9:
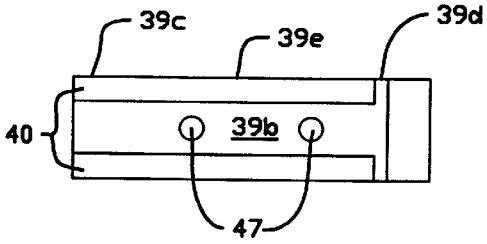

FIGS. 6 and 7 illustrate a second embodiment of clamping device 10 wherein the mass flow controller 12 has been re-oriented 180° so that the inlet 18 can be clamped against main body 14 to effect a seal therebetween. In this embodiment of the invention, a second stop block 39 is used in place of first stop block 38. Referring now also to FIGS. 8–10, second stop block 39 is constructed as a generally flat rectangular block that includes a front face 39*a*, a back face 39*b*, first side portion 39*c*, second side portion 39*d* and center portion 39*e* between first and second side portions 39*c* and 39*d*. Side portions 39*c* and 39*d* are sized and shaped to fit into stop block channels 32 in side plates 24. A pair of tongue members 40 project from back face 39*b*. Tongue members 40 are sized and shaped to fit into grooves 22*c* in back end piece 22. Tongue members 40 extend along first side portion 39*c*, across center portion 39*e* and into second side portion 39*d*. Tongue members 40 terminate at a z axis alignment stop 42 on second side portion 39*d*.

A cylindrical opening 44 is formed in the center of the front face 39*a* of second stop block 39. Opening 44 is sized and shaped to engage end caps 19, which are placed on both the inlet 18 and outlet 14 of controller 12 when the controller is not in use. A pair of horizontally oriented holes 47 extend through center portion 39*e* of second stop block 39. Holes 47 are positioned along a horizontal centerline on either side of opening 44 so that, upon insertion of second stop block 39 into positioning fixture 25, holes 47 are aligned with the two fastening screws 15 used to secure inlet 18 to main body 16 of controller 12.

FIG. 15 illustrates a third embodiment of clamping device 10 wherein a pneumatic cylinder 70 is used in place of the lead screw used in the previously described embodiments. Also, the embodiment of FIG. 15 uses a platform 74 to support the controller 12 instead of support rails 34. Referring to FIG. 15, clamping mechanism 28 consists of a pneumatic cylinder 70 (shown as a pancake type air actuator) and a carriage 54. Pneumatic cylinder 70 is mounted on front end piece 20. Shaft 72 extends through front end piece 20 to engage carriage 54. Pneumatic cylinder 70 generates the clamping force and carriage 54 advances to transmit that force against controller 12 to press controller 12 against stop block 38. The controller 12 is supported on platform 74. Platform 74 is mounted in a narrow elongated slot 78 that extends along the inner surface 24*c* of side plates 24.

The stop blocks described herein are configured for use with a Unit Instruments, Inc. Model UFC-1600 or Precision Flow Devices Model PFD 501M mass flow controller. As will be apparent to those skilled in the art, multiple stop blocks may be configured as necessary to accommodate other models or brands of mass flow controllers as well as other work pieces. The structural components of the invented clamping device may be made of any suitable structurally stable corrosion resistant material such as stainless steel.

While there is shown and described three embodiments of the invented clamping device, it is to be understood that the invention is not limited thereto. The invention may be applied to work pieces other than a mass flow controller and various other embodiments are possible without departing from the scope of the invention as set forth in the following claims.

What is claimed is:

1. A clamping device for a workpiece, comprising:

a front member;

a back member, wherein said back member defines at least one groove;

opposing side members coupled to said front member and said back member, wherein said opposing side members define two ends of a channel across said opposing side members, wherein said back member defines a side of said channel; and wherein said groove is aligned with said channel;

a clamping mechanism configured to operatively couple between said front member and said workpiece; and a plurality of stop blocks configured to interchangeably interpose between said back member and said workpiece; wherein said plurality of stop blocks are further configured to interchangeably fit inside said channel and wherein said plurality of stop blocks comprise:

a first block having:

a back configured to engage said back member, and a front configured to engage a first portion of said workpiece, and a second block having:

a back similar to said back of said first block, and a front configured to engage a second portion of said workpiece.

2. The clamping device in claim 1, wherein said back of said first block comprises:

at least one tongue commensurate with and configured to fit into said at least one groove; and an alignment stop.

3. The clamping device in claim 2, wherein:

said first block defines a surface channel ranging from said front to said back of said first block and configured to expose a fastener on said first portion of said workpiece; and said second block defines an internal opening ranging from said front to said back of said second block and configured to expose a fastener on said second portion of said workpiece.

* * * * *